US005876285A

United States Patent [19]

Salour et al.

[11] Patent Number: 5,876,285

[45] Date of Patent: Mar. 2, 1999

[54] CABINET AND HOPPER COMBINATION FOR GAMING MACHINES

[75] Inventors: David D. Salour; James R. Woodhams, both of Las Vegas, Nev.

[73] Assignee: Aurora Gaming, Las Vegas, Nev.

[21] Appl. No.: 975,786

[22] Filed: Nov. 21, 1997

[51] Int. Cl.[6] ..... G07F 1/04

[52] U.S. Cl. ..... 463/29; 194/350

[58] Field of Search ..... 463/20, 46, 29, 463/25; 273/143 R; 194/350

[56] References Cited

U.S. PATENT DOCUMENTS

| | | | |
|---|---|---|---|
| 642,151 | 1/1900 | Sargent et al. | 222/556 |
| 1,879,884 | 9/1932 | Rowe | 312/222 |
| 2,613,793 | 10/1952 | Erickson et al. | 273/143 R |
| 2,642,881 | 6/1953 | Buchholz | 453/17 |
| 4,509,531 | 4/1985 | Ward | 128/736 |
| 4,676,358 | 6/1987 | Rosendahl, Jr. | 194/203 |
| 4,752,274 | 6/1988 | Abe | 453/32 |
| 5,044,483 | 9/1991 | Stefan | 194/350 |
| 5,113,990 | 5/1992 | Gabrius et al. | 194/206 |
| 5,211,275 | 5/1993 | Halsey et al. | 194/350 |
| 5,346,047 | 9/1994 | Ishida et al. | 194/200 |
| 5,386,903 | 2/1995 | Rothschild et al. | 194/350 |
| 5,467,857 | 11/1995 | Takemoto | 194/206 |
| 5,579,888 | 12/1996 | Slyper | 194/350 |

*Primary Examiner*—Benjamin H. Layno
*Attorney, Agent, or Firm*—Quirk & Tratos

[57] ABSTRACT

A cabinet and hopper combination is set forth for slot machines which includes a cabinet structure having an opening for coins to drop from the machine into the hopper. The hopper is removably mounted in the cabinet and has a door slidable between a closed and an open position. A handle at the outside of the cabinet operates a linkage coupled to the door to open the hopper to dispense coins or tokens therein through the front of the cabinet. Also included are devices to lock the handle against unauthorized dispensing of coins or tokens.

26 Claims, 4 Drawing Sheets

CABINET AND HOPPER COMBINATION FOR GAMING MACHINES

FIELD OF THE INVENTION

The present invention relates to cabinets and hoppers for gaming machines such as slot machines.

BACKGROUND OF THE INVENTION

It is known to provide a stand for gaming machines such as slot machines, video poker machines and the like to support the machine at a position convenient for play by a player. Often these machines are placed side by side on one or more stands to define a bank of machines.

In relation to known gaming machines, these machines are adapted to receive wagers in the form of coins or tokens. When the wager of the coin or token is inserted, the coin passes a coin tester which verifies the authenticity of the wager and is directed to a machine hopper contained within the gaming machine housing. When a payout is made by the machine or the player cashes out, coins or tokens are dispensed from the machine hopper.

Because the reservoir defined by the machine hopper is limited due to the size of the machine and the need to include electronic and mechanical components in the housing, it is known to provide a machine hopper overflow bucket in the stand below the machine. When the machine hopper is full, additional wagered tokens or coins are directed through a hole in the bottom of the machine and to the bucket in the stand. From time to time personnel remove the buckets from the stands below the machines for weighing and counting of the coins.

Because the buckets may be heavy, injury to personnel sometimes occurs as a result of the bending, kneeling and pulling necessary to pull the bucket from the stand. It would be useful to devise a system which would not require personnel to bend, stoop, reach and pull to unload hopper overflow. Further in this regard, it would useful to remotely know and monitor when overflow is being removed and to prevent unauthorized unloading of the overflow.

SUMMARY OF THE INVENTION

There is, therefore, set forth according to the present invention a hopper and cabinet combination for gaming devices of the type adapted to receive token or coin wagers which provides for the unloading of machine overflow in a simple, convenient fashion, which provides for remote monitoring of activities related to unloading and which provides other features and advantages.

Toward this end, a hopper and cabinet combination is set forth wherein the cabinet includes a top to support the device, the top having an opening to pass overflow tokens from the device. A cabinet frame structure supports the top and defines a receptacle for a hopper below the device. The hopper includes front, side and rear walls converging from a mouth to a chute adapted to dump coins from the hopper through the front of the cabinet in a controlled fashion. Means are provided for removably securing the hopper in the receptacle. To control the discharge of coins or tokens from the hopper, a door is disposed in the chute and slidably movable from a closed position to an open position. An actuator such as a handle is provided at the cabinet front. Means responsive to the actuator slide the door from the closed position to an open position to release retained coins from the hopper through the chute and front of the cabinet to a bucket or container which has been aligned to register with the discharge of the chute.

Preferably a pair of openings are provided in the top of the cabinet, one of which is oblong and the other of which is kidney-shaped to register with different type of gaming machines to pass the overflow coins and tokens therefrom.

Preferably, the actuator is a handle which is adapted to be pulled and pushed along a longitudinal axis. The handle is coupled at one end to a linkage which, in turn, is coupled to the door for the sliding motion thereof. Also preferably, locking means are provided to lock the handle against movement and unauthorized or inadvertent discharge of coins from the hopper. Also, sensors may be provided to sense movement of the handle or movement of components in relation to the lock to remotely monitor activities concerning the hopper.

Further features include means for removably securing the hopper within the cabinet receptacle so that it can easily be taken out for servicing or replacement. Still further, the cabinet is provided with access ways for the running of electrical and communication lines.

BRIEF DESCRIPTION OF THE DRAWINGS

These and other features and advantages of the present invention will become better understood with reference to the specification, claims and drawings wherein:

DESCRIPTION

Figure 1:
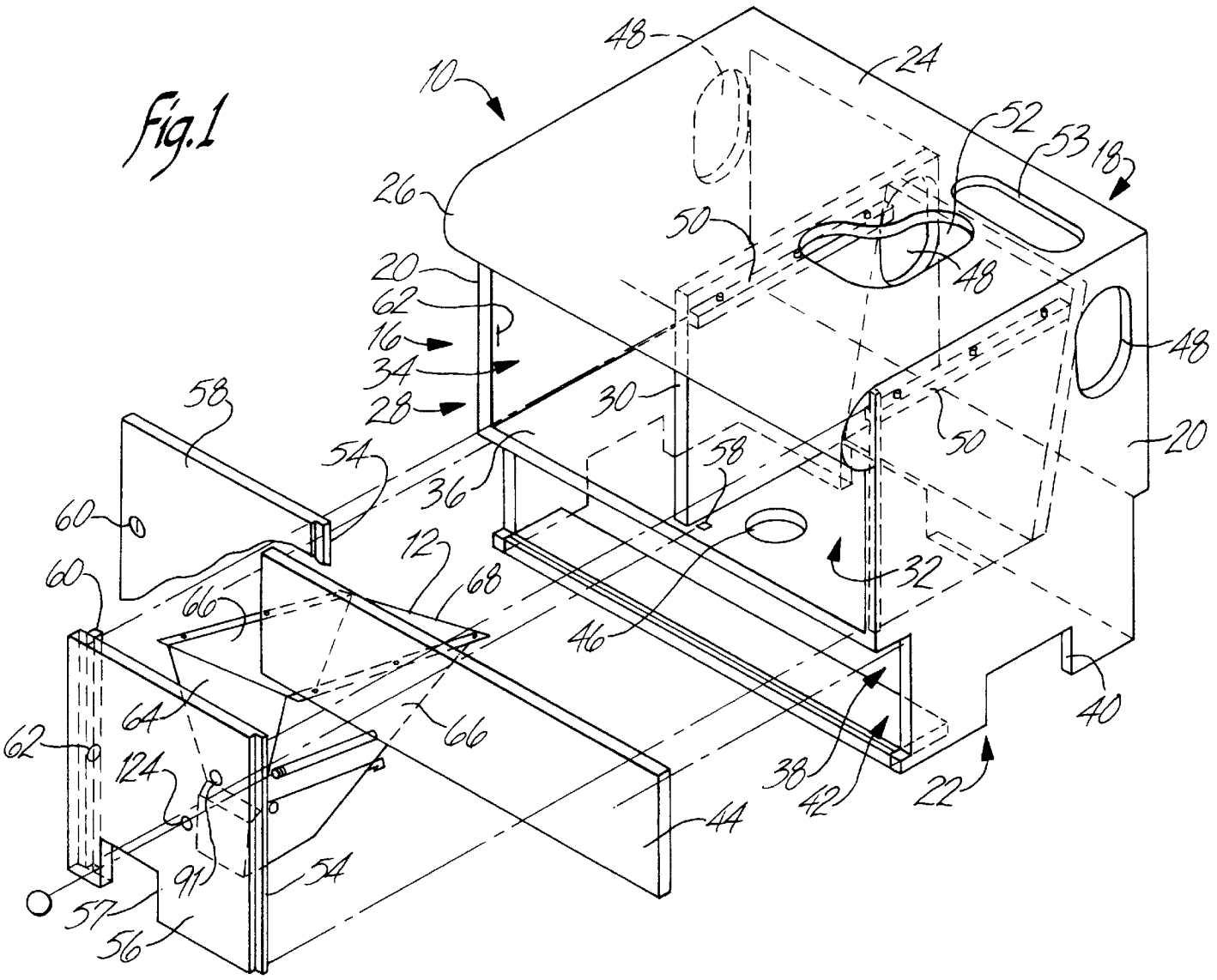
FIG. 1 is a perspective, exploded view of the cabinet and hopper combination of the present invention.

With reference to the drawings, FIG. 1 shows a cabinet 10 and hopper 12 combination according to the present invention. The cabinet 10 is essentially adapted to support a gaming device 14 (FIG. 3) above the floor for play by a player. Accordingly, the cabinet 10 and hopper 12 combination can be placed side by side and back to back to support a bank of gaming devices 14 in the usual configuration found in casinos.

The cabinet 10 has a front 16, back 18, sides 20, bottom 22, top 24 as well as internal bracing defining a frame structure for the cabinet 10. The flat, rigid top 24 has a width and depth dimension usually slightly greater than the footprint of the gaming device 14 to be placed thereon. At the front 16, the top 24 merges into a bullnose 26 which presents an aesthetic, curved surface at the front of the cabinet 10. Below the top 24 is defined an enclosed receptacle 28 which may have a partition wall 30 to define in the receptacle first and second compartments 32, 34. The bottom of the receptacle 28 and the first and second compartments 32, 34 is defined by a floor 36 which is spaced above the bottom 22 of the cabinet 10. The space between the floor 36 and bottom 22 defines a hollow way 38 for the passage of electrical and data communication conduits through and beneath the cabinet 10. Rectangular cutouts 40 in the sides 20 at the bottom 22 provide access into the way 38. Further access is provided by a large opening 42 at the front 16 of the cabinet 10 which is covered by a removable kick plate 44. The kick plate 44 may be attached to the cabinet 10 by fasteners such as screws or the like. To provide a passageway from the way 38 into the receptacle 28, a bore 46 is located in the floor 36. On the sides 20, proximate the top 24 and back 18 as well as through the partition wall 30 are located openings 48 to provide likewise for the passage of electrical and communication conduits into and through the cabinet 10.

To support the hopper 12 in the manner hereinafter described in the first compartment 32, the cabinet 10 includes a pair of spaced supports 50 disposed within the first compartment 32 along one side 20 and the partition wall 30. Preferably the supports 50 are arranged to be coplanar and parallel and are located equidistant from the top 24.

With continuing reference to FIG. 1, to provide a passageway for coins overflowing from the gaming device 14 into the hopper 12, the cabinet top 24 has a first hole 52, which preferably is kidney-shaped, and an oblong, second hole 53 arranged to register with and pass overflow from the various types of gaming machines. Gaming machines often differ as to how the coins which overflow from the internally maintained hopper fall from the machine. Accordingly, by providing the kidney-shaped hole 52 and oblong second hole 53, various type of gaming machines can be placed on the cabinet 10 so that overflow coins therefrom can drop through one of the first or second holes 52, 53 into the hopper 12.

To provide a means to close the receptacle 28 and more particularly the first and second compartments 32, 34, the side 20 proximate the front of the first compartment 32 includes a groove adapted to receive a tongue 54 for a first compartment covering first panel 56. Opposite the groove, the first compartment 32 includes a rectangular hole 58 adapted to receive a rectangular rod 60 movably disposed on the first panel 56 and located to be aligned therewith. A key lock mechanism 62 is adapted to be operated by a key to move the rod 60 to engage the hole 58 to lock the side of the first panel 56 remote from the tongue 54 to the cabinet 10. The key lock 62 operates, in a known fashion, to vertically displace the rod 60 to move in and out of the hole 58 to secure the first panel 56 to the cabinet 10. Accordingly, to connect the first panel 56, the user inserts the panel from left to right (FIG. 1) such that the tongue 54 is received into the groove formed in the first compartment 32 wall and thereafter the panel is placed in position covering the first compartment. The key lock 62 is manipulated to cause the rod 60 to be inserted into the hole 58, securing the first panel 56 to the cabinet 10.

In a similar fashion, a second panel 58 is provided and has a tongue 54 adapted to be received in a corresponding groove fashioned in the partition wall 30. The second panel 58 is thereafter moved into position to close the front of the second compartment 34 and a lock 60 is operated which causes a finger to be received in a slot 62 formed in the side 20 defining the second compartment 34. In this position, the second panel 58 is locked to the cabinet 10 closing the second compartment 54.

Figure 2:
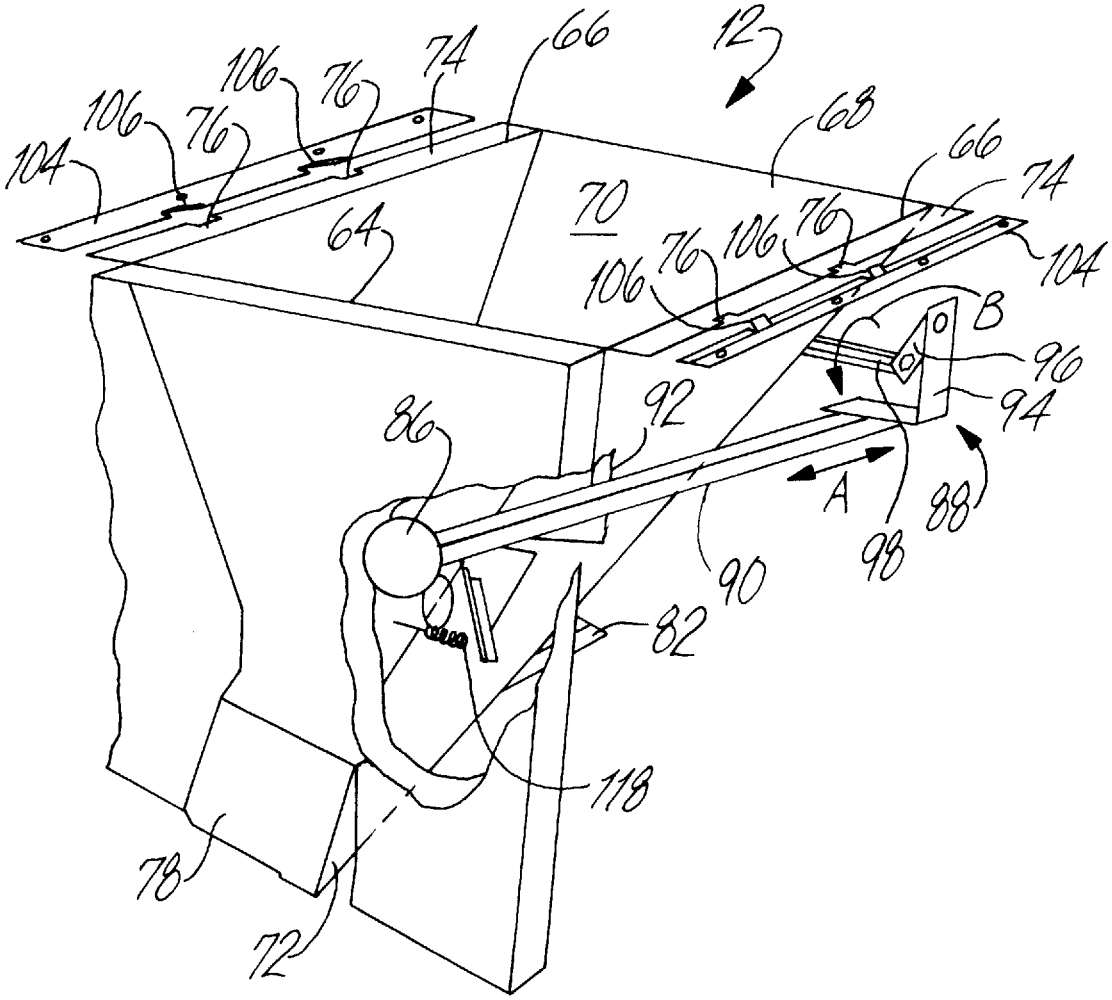
FIG. 2 is a front, right side perspective view of the hopper of the present invention.
Figure 3:
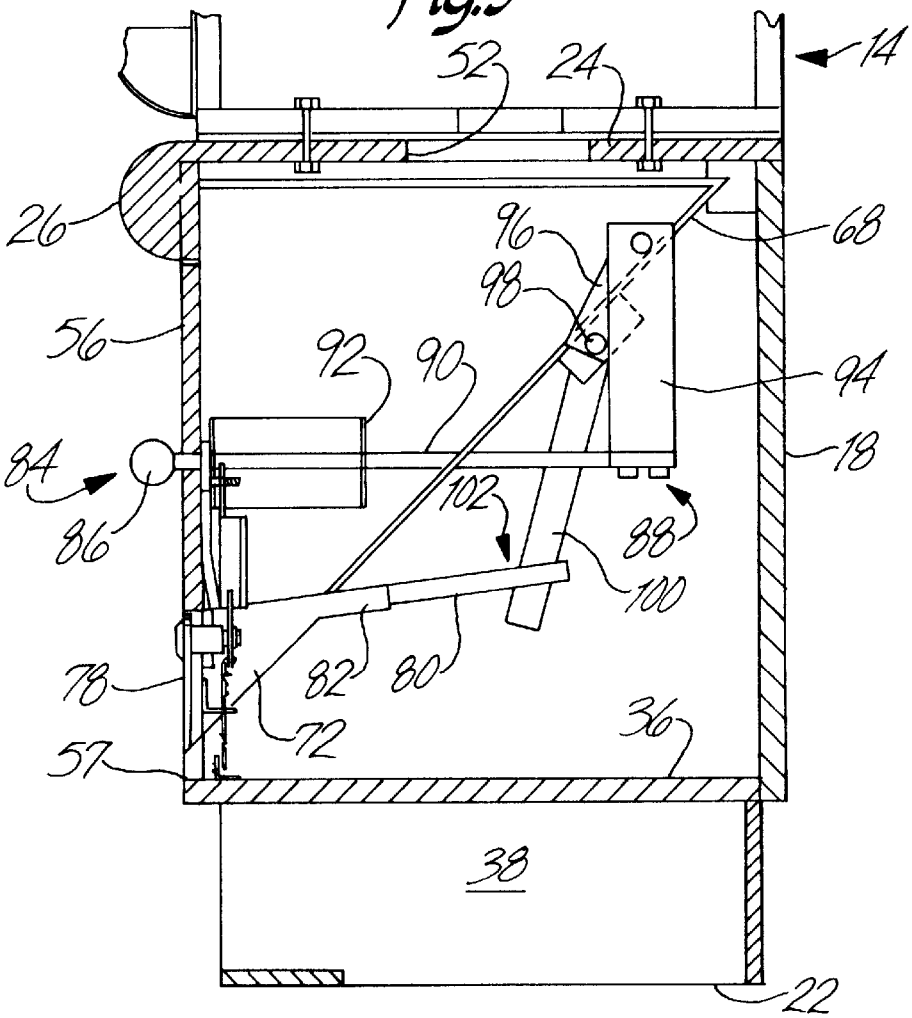
FIG. 3 is a side section view of the cabinet showing the hopper and the mechanism for operating the door thereof.

With reference to FIGS. 1 through 3, the hopper 12 according to the present invention is shown. Hopper 12 has a front wall 64, side walls 66 and a rear wall 68 which converged from an enlarged, open mouth 70 to a chute 72. The front, side and rear walls 64, 66, 68 are preferably fashioned from sheet metal as is the chute 72. Proximate the mouth 70, the hopper 12 has flanges 74 defined at the side wall 66. The flanges 74 project horizontally, when the hopper 12 is disposed in the cabinet 10, and include one but preferably a pair of slots 76 spaced therealong. At the opposite end, the hopper 12 terminates at a swinging cover 78 which is normally closed over the chute 72 but which pivots outwardly from the front wall 64 to permit coins or tokens to be discharged from the hopper 12 in a manner hereinafter described. When the hopper 12 is disposed in the cabinet 10 the chute 72 projects through the first panel 56 to discharge coins at the front 16 of the cabinet. Accordingly, the first panel 56 has an opening 57 for the chute 72.

To retain the coins or tokens within the hopper 12, the hopper 12 has a door 80 slidable between a closed and an open position. In the closed position, door 80 is disposed to block the chute 72 and prevent coins or tokens from being discharged therefrom. In the open position, the door 80 is withdrawn opening the chute 72 for the discharge of the coins therethrough and through the cover 78. Door 80 is preferably planar and is retained between a pair of tracks 82 defined at the sides 66 of the hopper 12 proximate its transition to the chute 72. In this position, the door 80 is slidable within the tracks 82 from a closed position closing the chute 72 to a withdrawn or open position opening the chute 72 for the discharge of coins or tokens.

To move the door 80 between the open and closed positions, the cabinet and hopper combination of the present invention includes an actuator to actuate the door preferably embodied as a handle 84 having at one end a knob 86 disposed at the front 16 of the cabinet 10 and at the other end coupled to a linkage 88 adapted to operate the door 80. As shown in FIG. 2, the handle 84 has a square shaft 90 which is adapted to pass through a hole 91 in the first panel 56 and to be coupled to the linkage 88. A brace 92 disposed at the side wall 66 of the hopper 12 supports the shaft 90 and handle 84 for longitudinal movement as suggested by arrow A of FIG. 2. Opposite the knob 86, the shaft 90 is coupled to an L-shaped first arm 94 which pivotally mounts at its end a second arm 96 which is, in turn, secured to a rod 98 rotatably disposed at the rear wall 68 of the hopper 12. As suggested in FIG. 2, pulling of the handle 84, pulls the first arm 94 toward the front wall 64 which in turn, through the second arm 96, urges the rod 98 to pivot as suggested by arrow B. With reference to FIG. 3, the rod 98 has disposed thereon a drive arm 100 which is received through a slot 102 fashioned in the door 80. Rotation of the rod 98 in the direction of arrow B displaces the drive arm 100 which, in turn, pulls the door 80 from a closed to an open position. Pushing the handle 84 rearwardly causes a reverse rotation of the rod 98 whereupon the drive arm 100 urges the door 80 to the closed position. Accordingly, an operator approaching the cabinet hopper combination according to the present invention need place a bucket or other container at the front of the cabinet 10 and pull the handle 84 to open the door 80 whereupon the coins or tokens retained within the hopper 12 are discharged through the chute 72 opening the cover 78 and dumping the coins or tokens into the bucket or container. The operator need not bend or stoop to pull a bucket from the cabinet 10.

To mount the hopper 12 within the cabinet 10, a pair of brackets 104 (FIG. 2) are retained at supports 50 as by screw fasteners or the like. Each of the brackets 104 includes a tab 106 adapted to be received through and register in each cooperative slot 76 when the hopper flanges 74 are properly aligned with the brackets 104. Preferably each bracket 104 has a Z-shaped cross-section defined by a flat to be secured to the supports 50 and a stepped-down flat. Accordingly, the user of the hopper 12 need only remove or open the first panel 56 and insert the hopper 12 into the first compartment 32 with the flanges 74 riding along the brackets 104 until the slots 76 are aligned with the tabs 104 whereupon the hopper 12 flanges 74 drop onto the flats and is aligned and retained in position on the brackets 104. The engagement of the tabs 106 in the slots 76 prevents forward and rear motion of the hopper within the first compartment 32. Downward motion is retained by engagement of the flanges 74 on the brackets 104 and upward movement is prevented by the weight of the hopper 12 itself.

Figure 4:
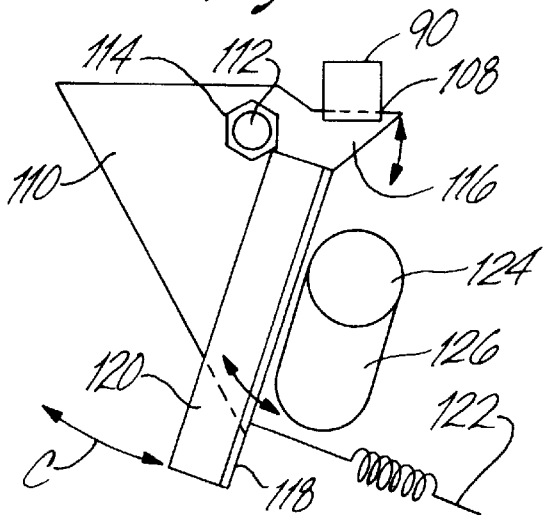
FIG. 4 is a rear view of one embodiment of the locking mechanism according to the present invention.

To lock the hopper 12 against unauthorized or inadvertent discharge of coins or tokens, means for locking the handle 84 are provided. With reference to FIG. 4, the shaft 90 of the handle 84 is shown engaged by the locking means. Accordingly, the shaft 90 includes a slot 108 defined along this length and adapted to be engaged by a locking plate 110 pivotally mounted to the inside of the first panel 56 by a bolt and nut 112, 114 for pivotal motion about the axis of the bolt 112. The plate 110 includes a tang 116 adapted to be received by the shaft slot 108 and a wing 118 which projects orthogonally from the plate 110 for the purposes of which will hereinafter become evident. Disposed proximate the wing 118 is a weight 120 which urges the plate 110 in a counter-clockwise direction as shown in FIG. 4 to maintain the tang 116 in engagement with the slot 108. To further urge the aforesaid engagement, a spring 122 may be connected between the wing 118 and hopper sidewall 66 to impose a counter-clockwise bias on the plate 110.

To displace the plate 110 such that the tang 116 disengages the slot 108, a lock 124 is provided on the first panel 56. The lock 124 is a key operated lock and includes a foot 126 coupled to the releasable cylinder of the lock 124. With reference to FIG. 4, the lock 124 is in a locked position with the foot 126 disposed such that the bias imposed by the weight 120 and/or the spring 122 urges the plate 110 such that the tang 116 is received in the shaft slot 108. When a key is inserted in a lock, the tumblers release the cylinder to rotate which rotates the foot 126 in the direction shown by arrow C to engage the wing 118 and to displace the plate 110 about the axis of bolt 112 so as to disengage the tang 116 from the shaft slot 108. In this position, the handle 84 is free to be pulled to operate the linkage 88 to move the door 80 from the closed to the open position to discharge coins or tokens from the hopper 12 into an awaiting bucket or container. After the coins or tokens have been discharged from the hopper 12 as fed by gravity, the handle 84 is pushed back into the first compartment 52 which operates the linkage 88 to return the door 80 to the closed position. The lock 124 is then rotated in reverse direction whereupon the bias imposed by the weight 124 and/or spring 122 urges the plate 110 to pivot to locate the tang 116 in the shaft slot 108 to prevent pushing or pulling of the handle 84 and the inadvertent or unauthorized discharge of coins or tokens from the hopper 12.

Figure 5:
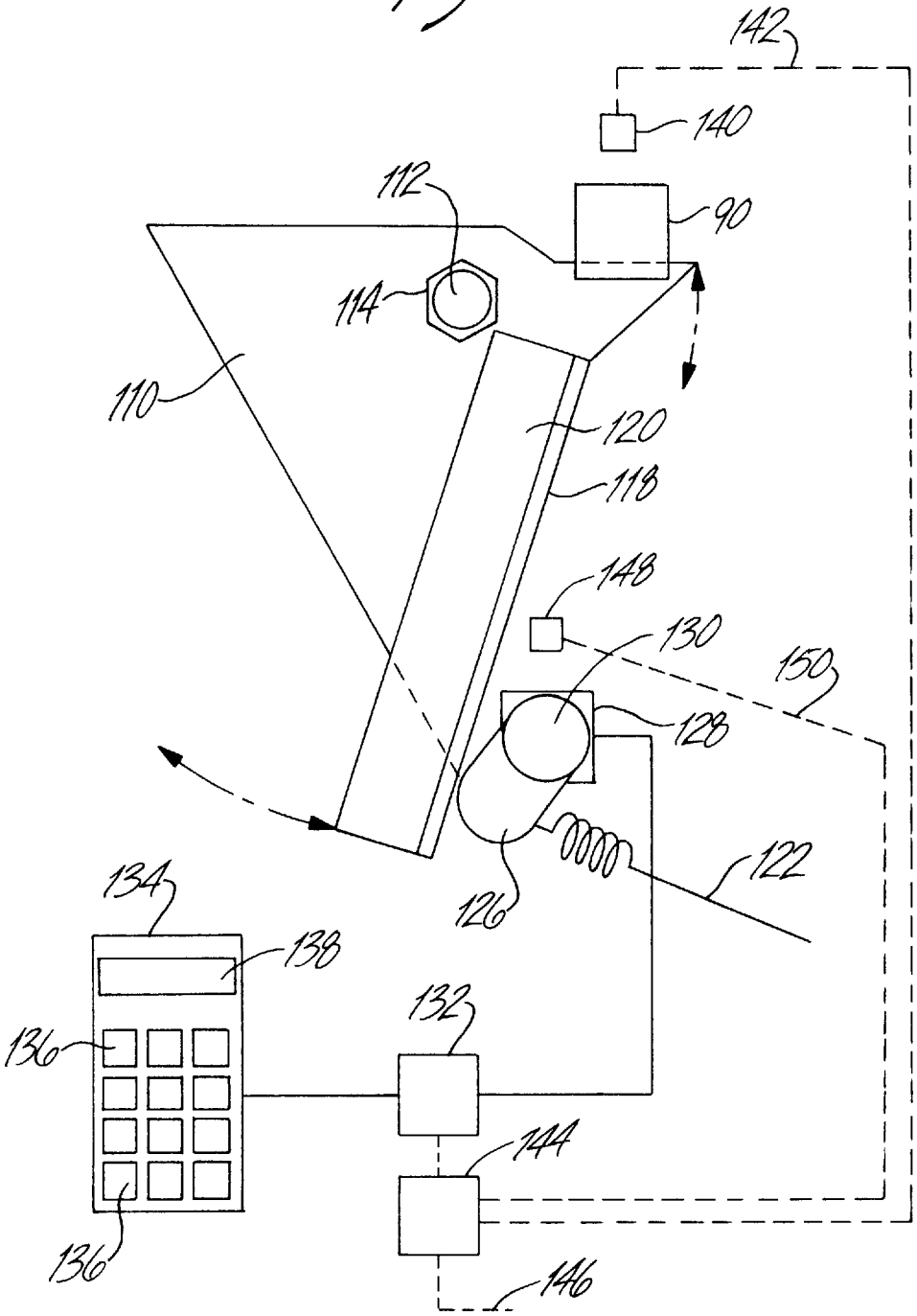
FIG. 5 is a rear view similar to that of FIG. 4 showing yet a further embodiment of the locking mechanism of the present invention.

With reference to FIG. 5, further locking means are shown. Like components bear the same reference numerals.

According to this embodiment, a stepper motor 128 is provided with a rotatable actuator 130 movable, in response to energizing the stepper motor 128, to rotate a foot 126 to displace the plate 110 in the manner described above. A controller 132 is provided to control the supply of power to the stepper motor 128, the controller accessed through a keypad 134 disposed at the first panel 56 of the cabinet 10. By the keys 136 on the keypad 134 and its display 138 personnel can input personal identification numbers and other codes to operate the controller 132 and thereby the stepper motor 128. Accordingly, personnel would input personal identification code into the keypad 134 which would operate the controller 132 to energize the stepper motor 128 to rotate the actuator 130 displacing the foot 126 engaging the wing 18 and pivoting the plate 110 to free the handle shaft 90 from the tang 116. In this position, the handle 84 may be pulled to operate the door 80 to discharge coins from the hopper 12. Once the coins have been discharged, the personnel inputs a proper security code into the keypad 134 which operates the controller 132 to reverse the stepper motor 128 and withdraw the foot 126 whereupon the plate 110 pivots in a reverse direction whereupon the tang 116 engages the shaft slot 108 to lock the shaft. It is to be understood that instead of the keypad 134, a card reader or other similar security device could be used to operate the controller 132 and thereby the stepper motor 128.

To monitor the operation of the hopper 12 according to the present invention, a first sensor 140 may be disposed to sense the lateral pulling or pushing of the handle shaft 90 in the manner suggested by FIG. 5. For example, when the shaft 90 is pulled to release coins, the first sensor 140 sends a signal 142 to a microprocessor 144 which, from the signal, generates data indicating displacement of the handle shaft 90, time of day and location. This data, by signal 146 is sent to a host processor to monitor the activity of the hopper 12. The host processor (not shown) would monitor the activity of a large number of hoppers 12 throughout the casino.

Additionally or alternatively, a second sensor 148 may be disposed to sense actuation of the stepper motor 128 and to generate a signal 150 in response thereto, that signal provided to the microprocessor 144. Again, the microprocessor 144, in response to the signal 150, generates data representative of the time, date, location of the signal as well as data which may identify the authorized individual operating the controller 132. This data, at data signal 146, is supplied to the host processor to monitor the operation of the hopper. Accordingly, by the first and second sensors 140, 148, the operation of the hopper 12 and the emptying of coins or tokens therefrom can be remotely monitored and the data representative thereof archived in a suitable data structure.

While we have shown and described certain embodiments of the present invention, it is to be understood that it is subject to many modifications without departing from the spirit and scope of the appended claims.

I claim:

1. A hopper and cabinet combination for a gaming device of the type adapted to receive token wagers, said combination comprising:

said cabinet includes (i) a top to support the device, said top having an opening to pass said tokens from the device, (ii) a frame structure to support the top define a receptacle for a hopper below said device, and (iii) a front;

said hopper includes front, side and rear walls converging from a mouth to a chute;

means for removably securing the hopper in the receptacle with the mouth aligned with the opening and the chute disposed at the cabinet front;

a door disposed in the chute and slidably moveable from a closed position to an open position;

an actuator at the cabinet front; and means responsive to said actuator for sliding the door from a closed position to an open position to release retained coins from the hopper to the front of the cabinet.

2. The combination of claim 1 wherein the opening is kidney shaped.

3. The combination of claim 1 wherein the means for removably securing the hopper in the receptacle includes a bracket disposed at either side of the receptacle, each bracket including an upstanding tab and said hopper includes a pair of flanges each adapted to seat on a bracket and including a slot to seat said tab.

4. The combination of claim 3 wherein each bracket includes a flat to receive and register with a flange.

5. The combination of claim 4 wherein each bracket has substantially a z-shape cross section defined by said flat and a mounting surface.

6. The combination of claim 3 wherein said bracket includes a pair of spaced tabs and each flange includes a pair of corresponding slots.

7. The combination of claim 1 wherein the hopper includes a track adapted to support and guide the door.

8. The combination of claim 7 wherein the track is disposed at the chute.

9. The combination of claim 8 wherein the door is flat having sides and the track includes a pair of spaced rails to receive and guide said sides.

10. The combination of claim 1 wherein the actuator is a handle and the responsive means includes a linkage coupled between the handle and door to translate movement of the handle to sliding of the door.

11. The combination of claim 10 including a shaft attached to the handle, the shaft having a longitudinal dimension and is adapted to slide longitudinally and said linkage includes a first arm coupled to the shaft, a rod mounted for rotation about an axis, a second arm coupled to the rod and pivotally attached to the first arm and a drive arm coupled to the door.

12. The combination of claim 11 wherein the door includes a slot to slidably receive the drive arm.

13. The combination of 10 including a shaft attached to the handle, the shaft having a longitudinal dimension and adapted to slide longitudinally and means for locking the shaft against said longitudinal sliding.

14. The combination of claim 13 wherein said shaft includes a notch and the locking means includes a plate, means for mounting the plate for pivotal motion from a lock to an unlock position, means for urging the plate to the lock position whereat the plate is received by the shaft notch and means for displacing the plate to the unlock position to free the handle for longitudinal movement.

15. The combination of claim 14 wherein the locking means includes a lock having a rotatable tumbler and a foot secured to the member to engage and displace the plate.

16. The combination of claim 15 further including at least one of a (i) first sensor means adapted to sense longitudinal movement of the handle shaft and issue a signal in response to said sensed movement and (ii) a second sensor adapted to sense movement of the foot and to issue a signal in response to sensed movement.

17. The combination of claim 16 including a controller adapted to receive signals from each sensor and to store data corresponding thereto.

18. The combination of claim 17 wherein said controller includes a clock and a memory and means for storing data corresponding to the time of receipt of a signal.

19. The combination of claim 15 including a host processor located remote from the device and means for issuing any signals thereto.

20. The combination of claim 14 wherein the locking means includes an electrically driven unit having a member, and means for energizing the unit to displace the member to displace the plate.

21. The combination of claim 20 including a controller including a data structure including code data and means for inputting a code, said controller in response to input of a code corresponding to said code data energizing said unit.

22. The combination of claim 21 further including a host processor and means for communicating a signal from the controller to the processor in response to energizing said unit.

23. A hopper and cabinet combination for a gaming device of the type adapted to receive token wagers, said combination comprising:

said cabinet includes (i) a top to support the device, said top having an opening to pass said tokens from the device, (ii) a frame structure to support the top define a receptacle for a hopper below said device, and (iii) a front;

said hopper includes front, side and rear walls converging from a mouth to a chute;

means for removably securing the hopper in the receptacle with the mouth aligned with the opening and the chute disposed at the cabinet front;

a planar door disposed in the chute and slidably moveable from a closed position to an open position;

a handle having a shaft, said handle moveable between a door open and a door closed position;

a linkage coupling the shaft to the door adapted to translate movement of the handle from the door closed position to the door open position to sliding of the door from the closed to the open position to dispense coins from the hopper through the chute.

24. The combination of claim 23 including means for locking the handle against movement said locking means including a lock having a displaceable member and a locking plate pivotally disposed between the lock and shaft and adapted to engage the shaft to prevent movement of the shaft, said member disposed to engage and displace the plate to release the handle.

25. The combination of claim 24 including means for sensing movement of the handle and generating a signal in response thereto.

26. The combination of claim 24 including means for sensing movement of the member and generating a signal in response thereto.

* * * * *